US005137267A

United States Patent [19]

Wirz et al.

[11] Patent Number: 5,137,267

[45] Date of Patent: Aug. 11, 1992

[54] SUCTION HEAD FOR A FEEDER OF A SHEET-FED ROTARY PRINTING PRESS

[75] Inventors: Arno Wirz, Bammental; Peter Sobotta; Jochen Renner, both of Heidelberg, all of Fed. Rep. of Germany

[73] Assignee: Heidelberger Druckmaschinen AG, Heidelberg, Fed. Rep. of Germany

[21] Appl. No.: 616,877

[22] Filed: Nov. 21, 1990

[30] Foreign Application Priority Data

Nov. 21, 1989 [DE] Fed. Rep. of Germany ..... 3938556

[51] Int. Cl.[5] ..... B65H 3/08

[52] U.S. Cl. ..... 271/14; 271/98

[58] Field of Search ..... 271/90, 91, 93, 98, 271/103, 106, 107, 10, 14

[56] References Cited

U.S. PATENT DOCUMENTS

| | | | |
|---|---|---|---|
| 3,007,697 | 11/1961 | Mosemiller | 271/90 X |
| 3,048,391 | 8/1962 | Spiess | 271/90 |
| 3,559,985 | 2/1971 | Janecek | 271/90 |
| 4,200,277 | 4/1980 | Klenk | 271/90 |
| 4,392,766 | 6/1983 | Blunt . | |
| 4,869,489 | 9/1989 | Wirz | 271/90 |

FOREIGN PATENT DOCUMENTS

| | | | |
|---|---|---|---|
| 0284806 | 10/1988 | European Pat. Off. . | |
| 3710994 | 10/1988 | Fed. Rep. of Germany . | |
| 834294 | 11/1938 | France . | |
| 322287 | 2/1972 | U.S.S.R. | 271/90 |
| 234776 | 9/1925 | United Kingdom . | |
| 399477 | 10/1933 | United Kingdom . | |
| 496173 | 11/1938 | United Kingdom . | |
| 525436 | 8/1940 | United Kingdom . | |
| 1051052 | 12/1966 | United Kingdom . | |
| 1305682 | 2/1973 | United Kingdom . | |
| 1449786 | 9/1976 | United Kingdom . | |
| 1598114 | 9/1981 | United Kingdom . | |
| 2182908 | 5/1987 | United Kingdom . | |

*Primary Examiner*—Richard A. Schacher

*Attorney, Agent, or Firm*—Herbert L. Lerner; Laurence A. Greenberg

[57] ABSTRACT

A suction head for a feeder of a sheet-fed rotary printing press for feeding sheets of small format through the press in a given direction, including only one double sucker formed of two juxtaposed suction nozzles connected by a transverse tube and being disposed transversely to the feeding direction of the sheets, the only one double sucker being exchangeably secured at a center location of the printing press.

6 Claims, 6 Drawing Sheets

Fig. 1
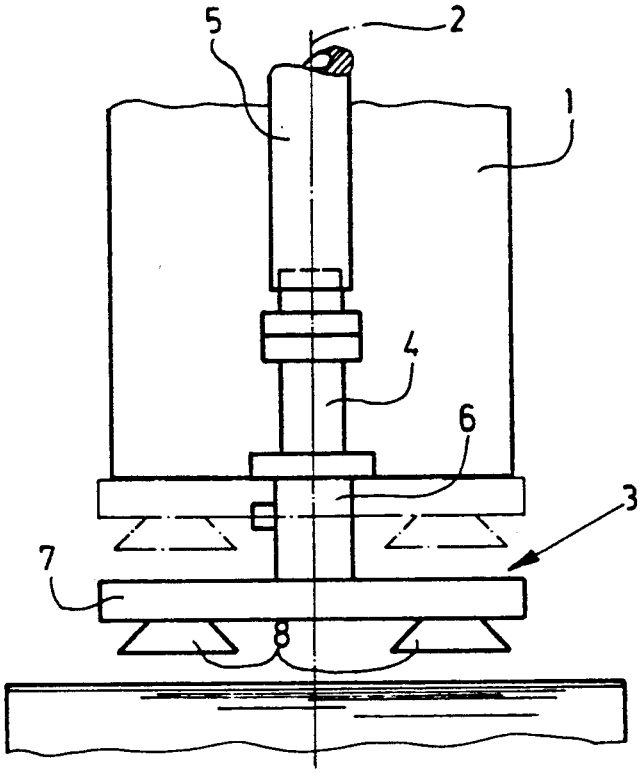
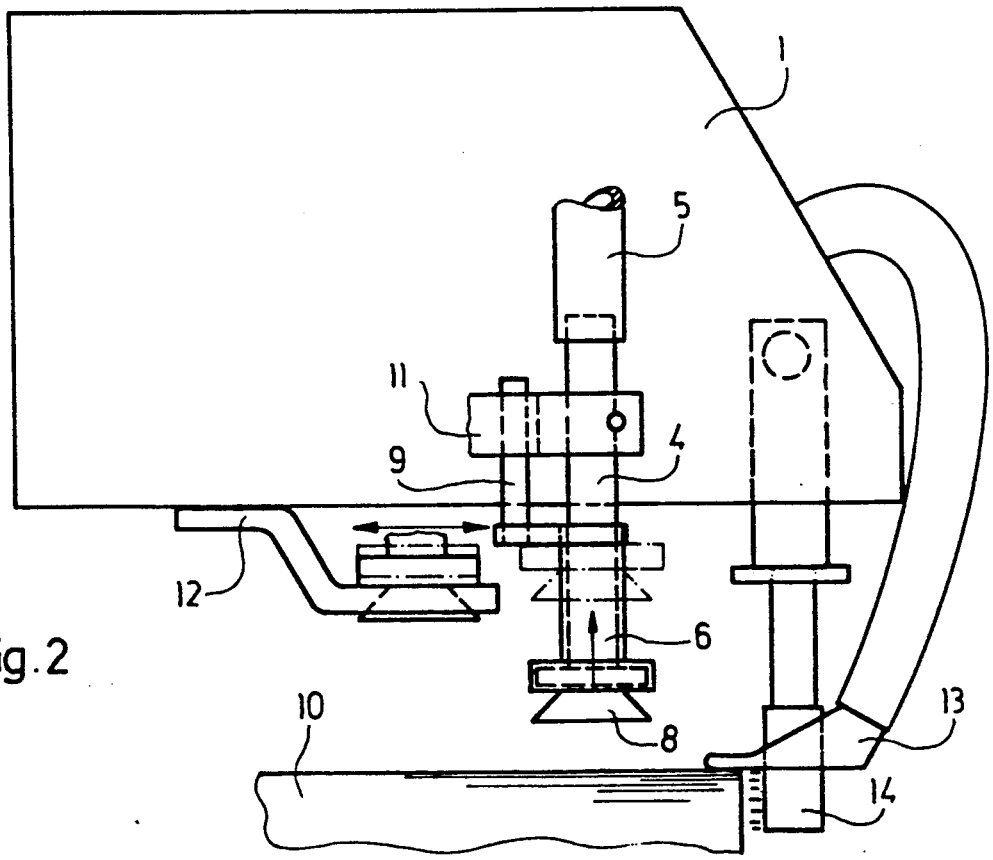
Fig. 2

Fig. 3
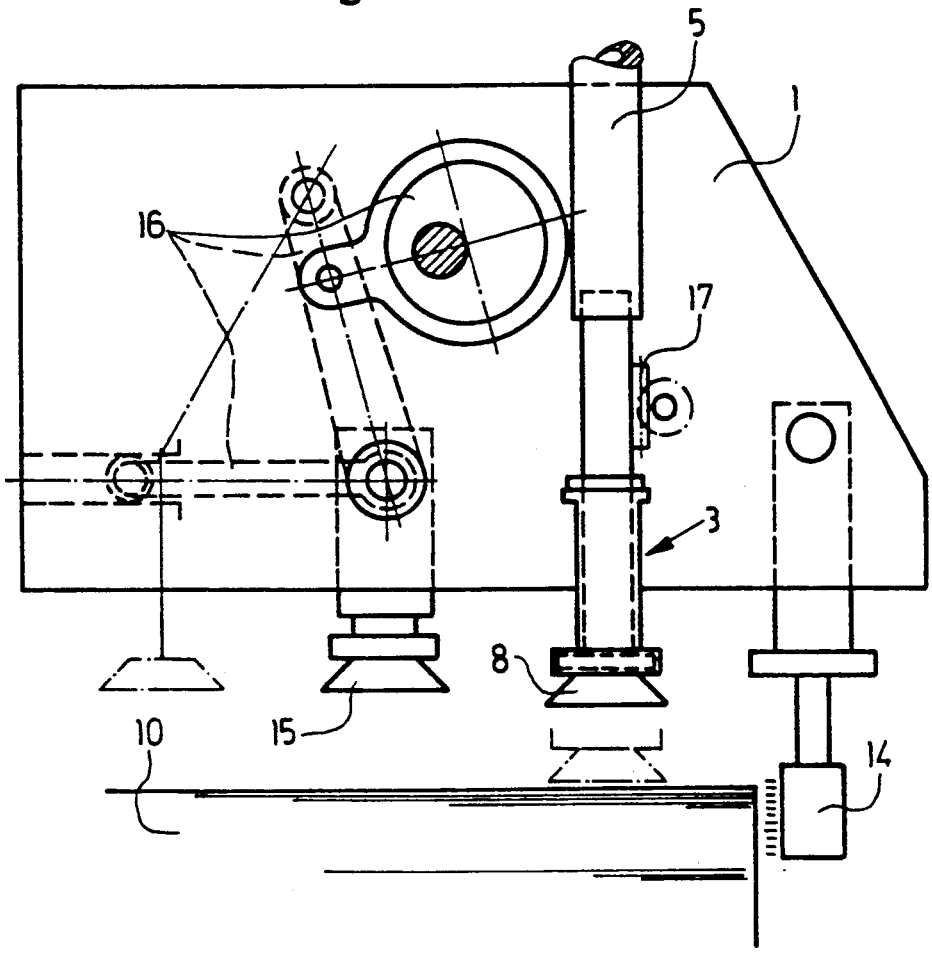
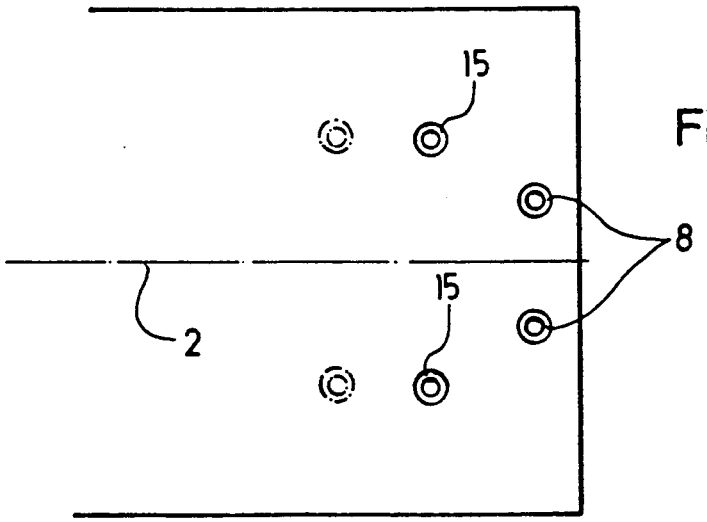
Fig. 3a

Fig. 6
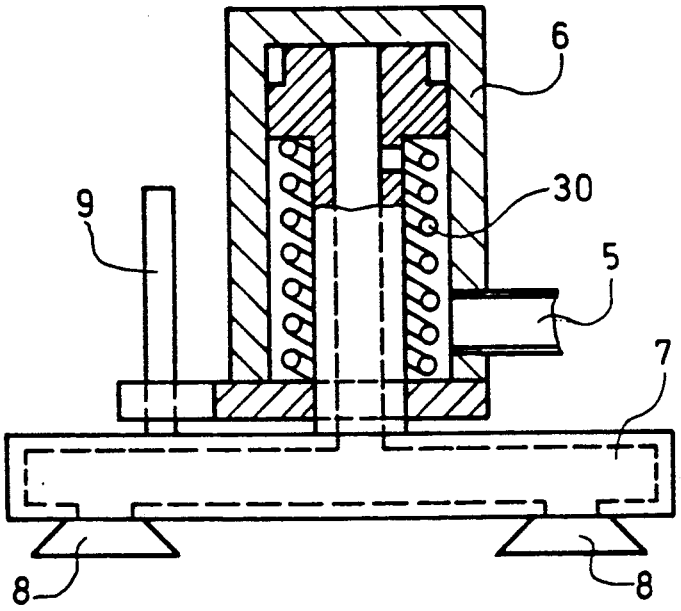
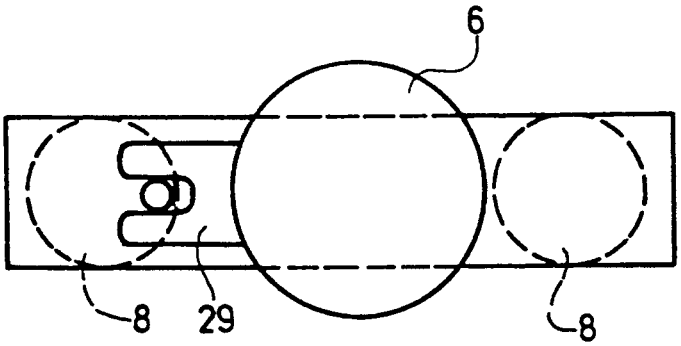
Fig. 7

SUCTION HEAD FOR A FEEDER OF A SHEET-FED ROTARY PRINTING PRESS

The invention relates to a suction head for a feeder of a sheet-fed rotary printing press and, more particularly, to such a suction head having a double sucker formed of two juxtaposed suction nozzles which are disposed in a line transversely to a sheet travel direction and are mutually connected by a tube extending transversely to the sheet.

Such a suction head has become known heretofore from U.S. Pat. No. 4,869,489. In the suction head, according to this patent, juxtaposed lift-type suckers, disposed transversely to sheet travel or feeding direction, are combined in pairs to form double suckers, one double sucker being disposed on each side of the suction head, so that at least two double suckers, usually, however, in conjunction with further suckers, comprise a suction head, which is of mirror-image symmetrical design with respect to a central longitudinal axis of the printing press. Furthermore, it has become known from the aforementioned patent to dispose the double sucker, in the form of a lift-type sucker with two suction nozzles, in a height-adjustable manner on a guide part, on which there is provided an axially displaceable, telescopically guided cylinder with a transverse tube attached thereto, the transverse tube connecting the two suction nozzles, so that both, together with the transverse tube and the cylinder, form a common suction chamber. A suction head with such double suckers is capable of processing all types of paper and cardboard at high conveying speeds without difficulty. Finally, it has become known from this patent to arrange the suction nozzles so that they are exchangeable.

The construction of the suction head and also of other heretoforeknown suction heads is based upon the maximum size or format of the sheet to be processed by a printing press. In the heretoforeknown constructions the suckers are disposed on both side of the central longitudinal axis of the printing press in mirror-image symmetrical positions with respect to the latter.

It is accordingly an object of the invention to provide a suction head of small size and of simple construction, in particular for processing small sizes or formats of paper, irrespective of the type of paper, the suction head being able to function efficiently at high processing speeds.

With the foregoing and other objects in view there is provided, in accordance with the invention, a suction head for a feeder of a sheet-fed rotary printing press for feeding sheets of small format through the press in a given direction, comprising only one double sucker formed of two juxtaposed suction nozzles connected by a transverse tube and being disposed transversely to the feeding direction of the sheets, the only one double sucker being exchangeably secured at a center location of the printing press.

Due to these features, the suction nozzles on the suction head are reduced to only one double sucker with two suction nozzles, the double sucker, however, being disposed in the center of the suction head and thus being symmetrically disposed on the central longitudinal axis of the printing press. This in particular, permits the processing of so-called small sizes, such as A-5 or A-6 or post-card and note-pad size, with a high degree of safety against stoppers at high press speeds, irrespective of the grade of paper, paste-board or cardboard being processed. By forming the lift-type suckers of plastic material, a double sucker results which is of simple and low-cost construction and has a relatively small and easily movable mass. To adjust to thin label paper, porous alpha paper or heavy cardboard, it is possible to select a double sucker with suitable suction nozzles and, with just a few manipulations, to attach it to the suction head. It is advantageous, therefore, for the connection of the double sucker to the suction head to be accomplished by means of plug-in connectors of conventional construction. This facilitates the removal of the centrally disposed double sucker if it is no longer required or if it is to be replaced.

The central positioning of only one double sucker thus provides advantages not only for the user of the printing press but also with regard to the manufacture of the printing press, because then only one connection, mounting and the like is required. Thus the number of components in the feeder our reduced, with the result that more space is available. Considerable economic advantage thus also results from this construction.

In accordance with another feature of the invention, there is provided a plug-in connector for fastening the double sucker in the suction head.

In accordance with a further feature of the invention, the double sucker is mounted so as to be swivellable about a horizontal axis.

In accordance with an added feature of the invention, the double sucker is disposed so as to be movable in the sheet feeding direction.

In accordance with an additional feature of the invention, the suction head includes transport suckers fastened therein, the double sucker being disposed so as to be movable, independently of the transport suckers, in the sheet feeding direction.

In accordance with again another feature of the invention, the suction nozzles of the double sucker are formed as jump-type suckers having an axially displaceable guidance part, means are provided for moving the transverse tube and the juxtaposed suction nozzles from a lower portion thereof upwardly on the guidance part when suction openings of the suction nozzles are closed by a sheet, and means are provided for releasing the sheet and returning the transverse tube and the juxtaposed nozzles to the lower position thereof.

In accordance with again a further feature of the invention, there are provided means for returning the double sucker in a direction opposite to the sheet-feeding direction to a starting location thereof, the returning means comprising a fixed cam guide.

In accordance with again an added feature of the invention, the double sucker is movable in the feeding direction from a given starting position, and the cam guide extends from a position disposed downstream from the given starting position, the double sucker being supported by the cam guide along substantially all of a return path from the downstream position to the given starting position.

In accordance with again an additional feature of the invention, the transverse tube of the double sucker is slidingly carried on the return path by the cam guide, with the juxtaposed suction nozzles straddling the cam guide.

In accordance with yet another feature of the invention, the only one double sucker is formed as a drop-type sucker wherein the suction nozzles are movable downwardly under suction-air influence and, after suction openings thereof are closed by a sheet suction-gripped by the suction nozzles, the suction nozzles are movable upwardly to an upper end position under vacuum and spring force actions.

In accordance with yet a further feature of the invention, there are provided means for adjusting the height of the suction nozzles with respect to a sheet pile.

In accordance with a concomitant feature of the invention, there are provided outwardly flaring, substantially conical nipples respectively disposed at an edge of the suction nozzles.

Other features which are considered as characteristic for the invention are set forth in the appended claims.

Although the invention is illustrated and described herein as embodied in a suction head for a feeder of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which:

FIG. 1 is a rear elevational view of a first embodiment of a suction head according to the invention having a double sucker in the form of a jump-type sucker;

FIG. 2 is a side elevational view of FIG. 1;

FIG. 3 is a view like that of FIG. 2 of another embodiment of the invention in conjunction with separate transport suckers;

Figures 4, 4A:
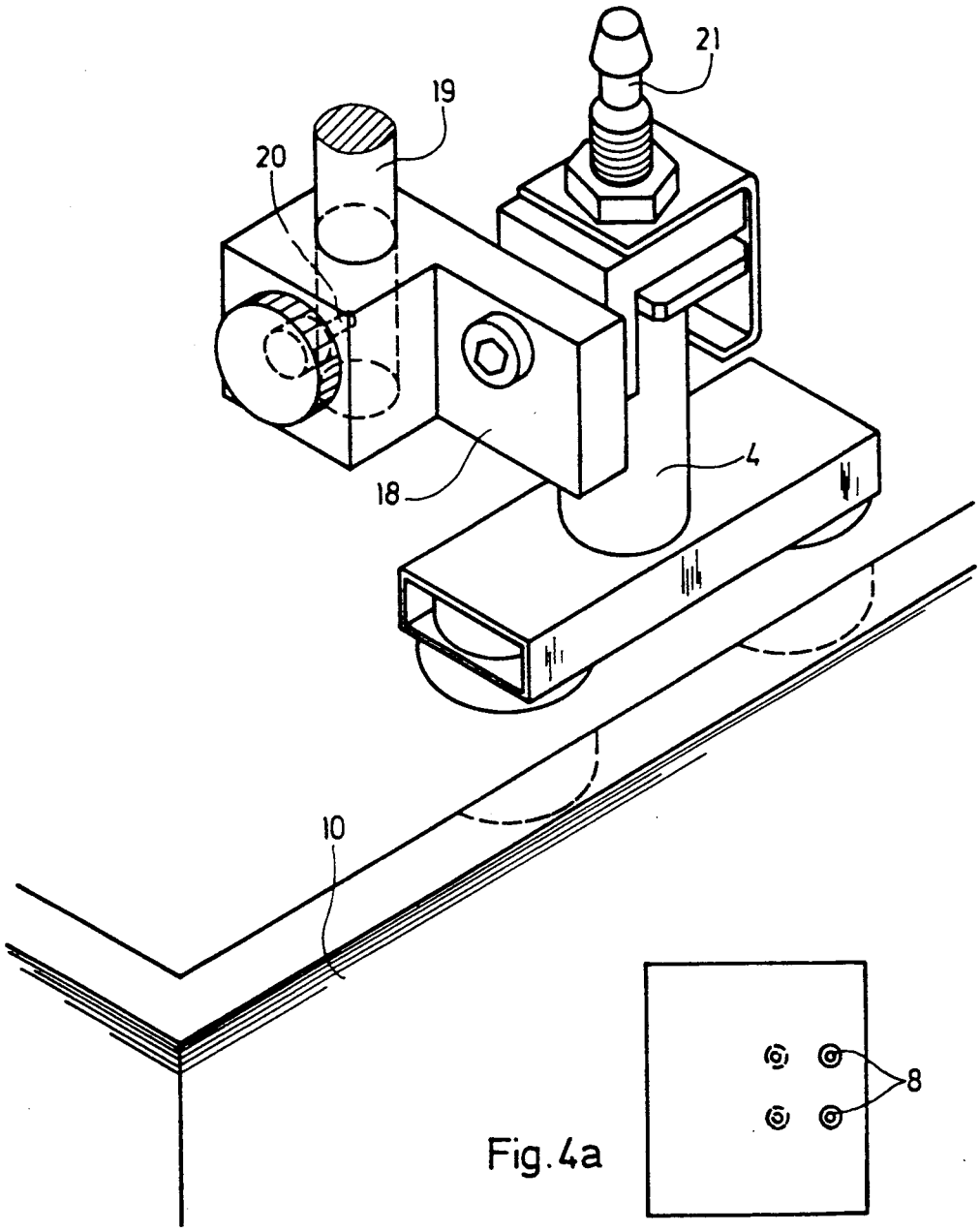
Figure 5:
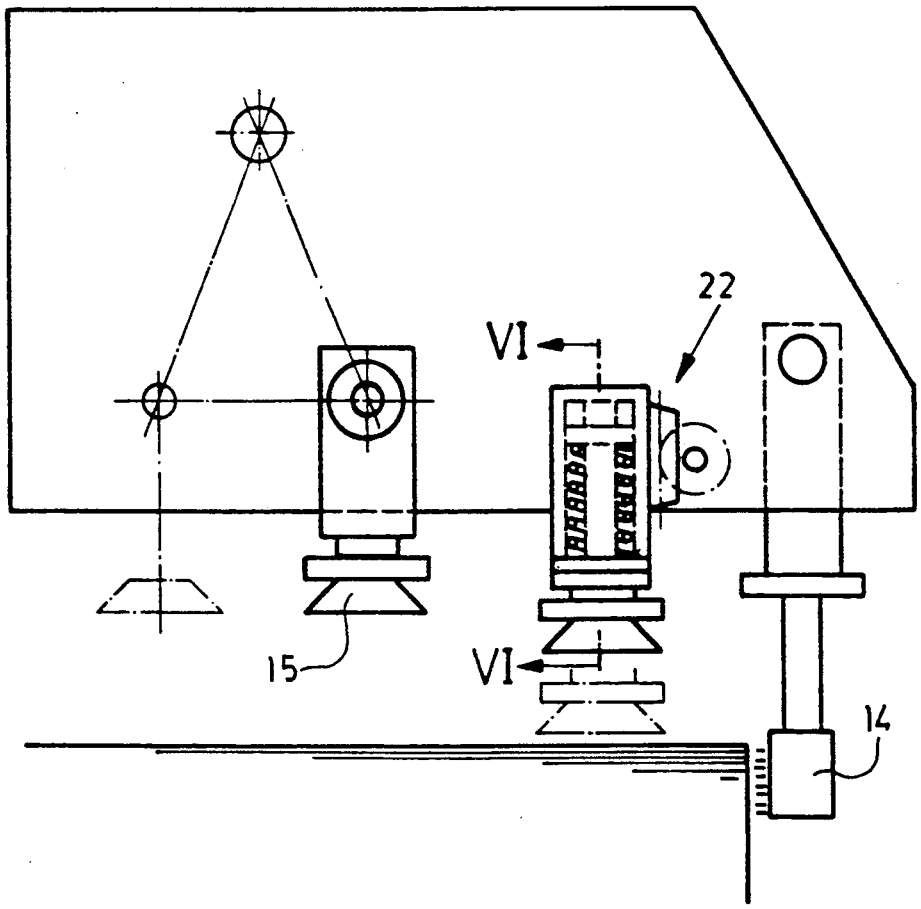
Figures 8, 8A:
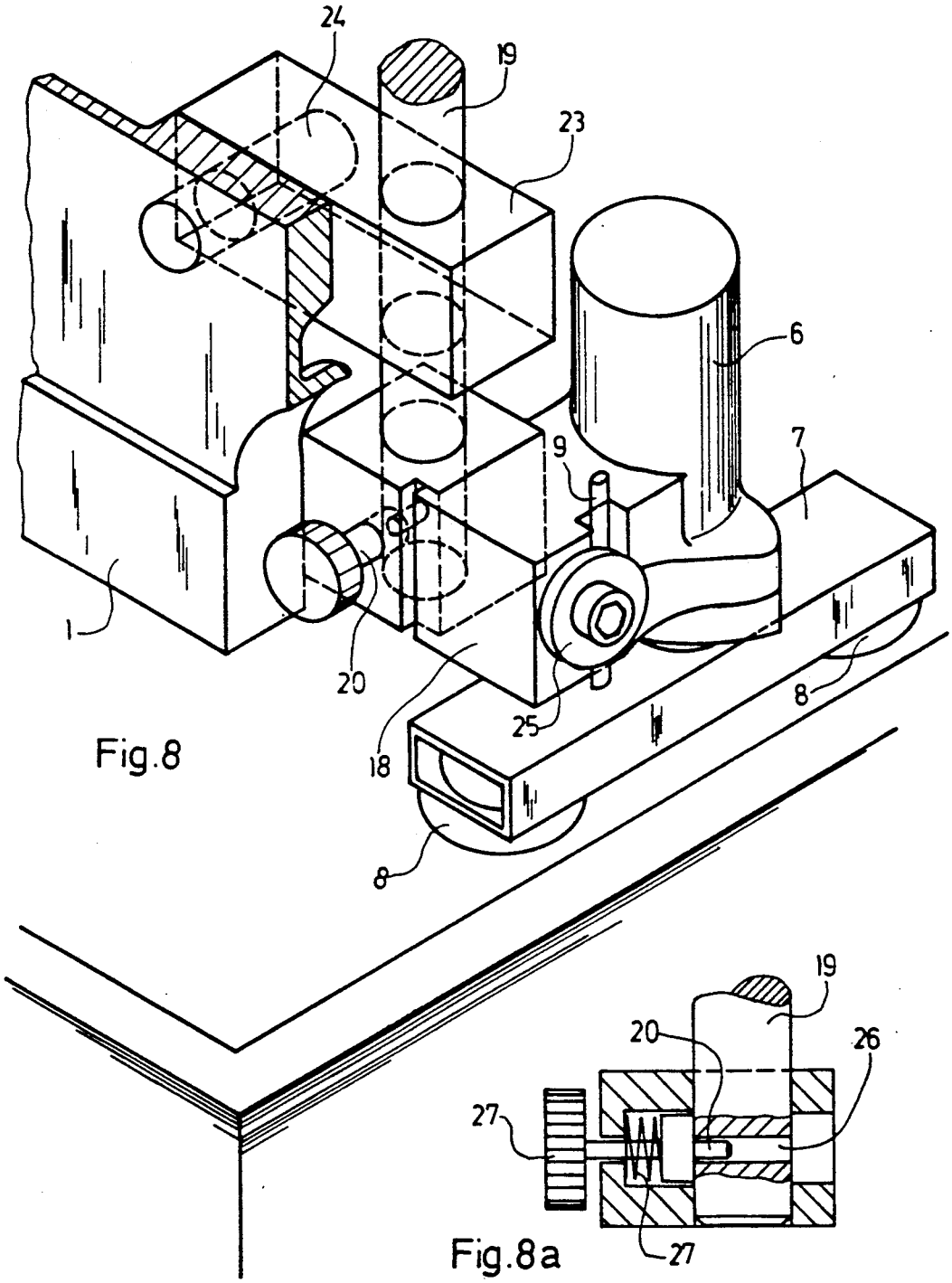

FIG. 3*a* is a diagrammatic bottom plan view of FIG. 3;

FIG. 4 is a perspective view of the double sucker of FIG. 1 and a means of attachment therefor;

FIG. 4*a* is a diagrammatic bottom plan view of FIG. 4;

FIG. 5 is a view like that of FIG. 3 of a third embodiment of the invention wherein the double sucker is in conjunction with additional transport suckers and is in the form of a drop-type sucker;

FIG. 6 is an enlarged vertical sectional view of FIG. 5 showing the double sucker in the form of a drop-type sucker;

FIG. 7 is a top plan view of FIG. 6;

FIG. 8 is an enlarged perspective view of FIG. 6 together with means of attachment for the double sucker; and FIG. 8*a* is a fragmentary sectional view of FIG. 8 showing an indexing-bolt mounting which forms part of the invention.

Referring now to the figures of the drawing, there are shown therein various embodiments having suction-head arrangements of the kind suitable for feeders of sheet-fed rotary printing presses. The suction head 1 is represented diagrammatically in outline. A center longitudinal plane of the feeder and a centerline for a double sucker 3 are identified by reference numeral 2 in FIG. 1 of the drawing. Especially for processing small sizes of paper, the double sucker 3 is disposed at the center of the machine symmetrically with respect to the plane 2, and is exchangeably attached to parts of the suction head 1. FIGS. 1 to 3 show a double sucker in the form of a jump-type or drop-type sucker, which is defined in that it maintains, due to its own dead weight and reinforced by the action of a spring, a lower end position thereof, and jumps or springs upwardly when its suction nozzles are closed. The double sucker 3 shown in FIG. 1 has a vertically disposed tubular guidance part 4, at the upper end of which there is connected an air line 5 and, at the lower end of which there is provided a vertically movable, tubular cylindrical part 6. A lower end of the cylindrical part 6 carries a transverse tube 7, which connects together two suction nozzles 8 having conical suction lips of elastic material, so as to form a common suction chamber. The double sucker 3 is secured against turning, as shown in FIG. 2, by means of a pin 9 attached to the cylindrical part 6, for which purpose the pin 9 passes through a clamping ring or bracket 11 attached to the suction head 1. The height to which the double sucker jumps or springs and the height at which the double sucker is located above the uppermost sheet on the pile of sheets 10 can be adjusted by moving the clamping ring 11.

In the arrangement according to FIG. 2, the jump-type sucker is disposed on the body of the suction head 1 so as to be able to move forwards and backwards in the conveying direction of the sheet, for example, by means of a mechanical lever transmission such as that which is described hereinafter for moving transport suckers (FIG. 3), with the result that the double sucker 3, which lifts the uppermost sheet off the pile 10 under vacuum, can be moved horizontally in the sheet conveying direction while it is in its upper suction-gripping position. Before the sheet drops from the suction nozzles 8 due to the admission of air at atmospheric pressure into the double sucker 3, however, the latter enters into the vicinity of a cam guide 12, which is formed as a sliding guide and supports the double sucker 3 in that upper position thereof so that, while it is being returned to the starting position shown in FIG. 2, the double sucker 3 is supported in the upper position thereof before it drops back into the position shown in the drawing. Thus, the embodiment of the invention constitutes an arrangement in which the double sucker 3 for lifting the uppermost sheet off the pile of sheets serves simultaneously as a transport sucker for the horizontal movement of the sheets in the feeder. In this regard, there is no absolute need for carrying or support air to be blown under the uppermost sheet, so that the feeler or sensor foot 13 shown in FIG. 2 does not have to blow additional carrying air under the lifted-off sheet. A loosening blower 14 ensures the preloosening of the sheets in the sheet pile 10.

Deviating from the arrangement according to FIG. 2, the embodiment of FIG. 3 has a double sucker 3 formed as a jump-type sucker, together with horizontally movable transport suckers 15, which are movable in the conveying direction of the sheet by means of a transmission, for example a mechanical lever transmission 16. In this embodiment of FIG. 3, the vertical movement of the double sucker 3 formed as a jump-type sucker is regulated, primarily in the upper end position, by a controllable locking element 17, by means of which it is possible simultaneously to adjust the height of the suction nozzles 8 above the uppermost sheet in the sheet pile 10. FIG. 3*a* shows the position of the suction nozzles 8 of the double sucker 3 and of the transport suckers 15 with respect to the center longitudinal axis 2 of the printing press, relative to the width of the sheets being processed. If necessary or desirable, the transport suckers can also be disposed centrally and can be formed as double suckers.

The exchangeable attachment of the double sucker 3 to the suction head 1 is shown in a perspective view in FIG. 4. The guidance part 4 is accordingly attached to a holder 18, which is formed with a vertical through-bore and is slidable, by means of the through-bore, on a pin or peg 19 fastened to the suction head 1 in the manner of a plug-in connector. The connection of the holder 18 to the peg 19 is accomplished, for example, by an indexing bolt 20, which is connected to an external handle or knob 29 and can be pulled back against the action of a non-illustrated spring, so that, under the action of that spring, it latches into a recess in the peg 19. The upper end of the guidance part 4 has a connecting nozzle 21 for the air hose 5. As is apparent from FIG. 4*a*, this embodiment of FIG. 4 corresponds with a horizontally movable arrangement of the double sucker 3 on the suction head 1 as shown in FIG. 2.

FIGS. 5 to 7 illustrate another embodiment of the invention wherein the double sucker 3 is formed as a fall or drop-type sucker, the generic nature of which is characterized by the suction nozzles 8 being pulled downward under the effect of vacuum, so that, with the suction openings closed by the sheet which has been lifted off, the suction nozzles jump or spring upward under the action of vacuum and with the support of an inner spring. In the drop-type sucker construction, the outer cylindrical part is fixed and is connected to the connection or junction for the air hose 5. The lower end of the tubular cylindrical part 6 carries the transverse tube 7, which connects the two suction nozzles 8 of the double sucker together. Because such a drop-type sucker, under atmospheric pressure, remains in the upper end position due to the action of a spring 30, a cam guide such as is shown in FIG. 2 can be dispensed with. In the embodiment shown in FIG. 5, transport suckers 15 are provided for the horizontal transport of the sheets, and, accordingly, ensure the horizontal transport of the sheet that has been lifted off the pile by the double sucker 3. Because drop-type suckers adapt or adjust automatically to the respective height of the uppermost sheet in the sheet pile 10, the possibility cannot be ruled out of two sheets being suction-gripped at the same time when the paper quality permits the suction effect to pass through the paper. To prevent the occurrence of such double suctions, the lower end position of the suction nozzles, and thus the distance to the upper sheet in the pile, is adjustable. Furthermore, the suction nozzles 8 should preferably be provided with nipple projections. For the purpose of guiding the suction nozzle 8, there is provided, as shown in FIGS. 6 and 7, a vertical pin 9, which is vertically movable in a recess formed on the cylindrical part 6 and prevents the double sucker from turning about its vertical axis. The adjustment in height of the suction nozzles 8 in the lower end position thereof above the uppermost sheet in the sheet pile 10 can be effected by adjusting the cylindrical part 6 as a whole, for example by means of a screw-type or rack-type height-adjusting device 22 as shown in FIG. 5.

For the purpose of exchangeably fastening the suction head 1, in the embodiment of FIG. 8, the cylindrical part 6 is fixedly connected to a holder 18 which, by means of a vertical through-bore formed therein, is slidable on a pin or peg 19 and is lockable to the latter by means of an indexing bolt 20. In this embodiment, the peg 19 is disposed on another intermediate member 23, which is movable with the suction head 1 about a horizontally disposed pin or peg 24, so that the holder 18 with the cylindrical part 6 fastened thereto is swivellable about the axis of the horizontal pin 24, as has previously been explained hereinabove. In this arrangement, the height adjustment is affected by the peg 19 being movable up or down by means of a height-adjusting device 22 (FIG. 5). FIG. 6 likewise illustrates a device for preventing torsion or turning which is formed of a pin 9, fastened to the transverse tube 7, and a fork 29 attached to the cylindrical part 6, the pin 9 being free to move vertically in the slot of the fork 29

FIG. 8*a* is a fragmentary cross-sectional view of FIG. 8 showing the indexing bolt 20, which engages in a transverse bore 26 in the peg 19 and which is withdrawable from the transverse hole 26 by the external handle or knob 27 against the action of a spring 28.

The foregoing is a description corresponding in substance to German Application P 39 38 556.6, dated Nov. 21, 1989, the International priority of which is being claimed for the instant application, and which is hereby made part of this application. Any material discrepancies between the foregoing specification and the aforementioned corresponding German application are to be resolved in favor of the latter.

We claim:

1. Suction head for a feeder of a sheet-fed rotary printing press for feeding sheets of small format through the press in a given direction, comprising only one double sucker formed of two juxtaposed suction nozzles connected by a transverse tube and being disposed transversely to the feeding direction of the sheets, said only one double sucker being exchangeably secured at a center location of the printing press, said double sucker being disposed so as to be movable in the sheet feeding direction, and means for returning said double sucker in a direction opposite to said sheet-feeding direction to a starting location thereof, said returning means comprising a fixed cam guide, said double sucker being movable in the feeding direction from a given starting position and said cam guide extending from a position disposed downstream from said given starting position, said double sucker being supported by said cam guide along substantially all of a return path from said downstream position to said given starting position.

2. Suction head according to claim 1 including a plug-in connector for fastening said double sucker in the suction head.

3. Suction head according to claim 1, wherein said suction nozzles of said double sucker are formed as jump-type suckers having an axially displaceable guidance part, means for moving said transverse tube and said juxtaposed suction nozzles from a lower portion thereof upwardly on said guidance part when suction openings of said suction nozzles are closed by a sheet, and means provided for releasing the sheet and returning said transverse tube and said juxtaposed nozzles to said lower position thereof.

4. Suction head according to claim 1, wherein said transverse tube of said double sucker is slidingly carried on said return path by said cam guide, with said juxtaposed suction nozzles straddling said cam guide.

5. Suction head according to claim 1, including means for adjusting the height of said suction nozzles with respect to a sheet pile.

6. Suction head according to claim 1, including outwardly flaring, substantially conical nipples respectively disposed at an edge of said suction nozzles.

* * * * *